US005634188A

United States Patent [19]

Johnston et al.

[11] Patent Number: 5,634,188

[45] Date of Patent: May 27, 1997

[54] REPRODUCTION MACHINE HAVING A HIGH CAPACITY CASSETTE TRAY ASSEMBLY

[75] Inventors: Donald E. Johnston; Bruce A. Winship, both of Rochester; Richard C. Benton, Ontario, all of N.Y.

[73] Assignee: Xerox Corporation, Stamford, Conn.

[21] Appl. No.: 585,228

[22] Filed: Jan. 11, 1996

[51] Int. Cl.[6] ..... G03G 15/00

[52] U.S. Cl. ..... 399/393; 271/127; 271/160

[58] Field of Search ..... 271/126, 127, 271/157, 158, 160, 170; 355/308, 309; 399/393

[56] References Cited

U.S. PATENT DOCUMENTS

| | | | |
|---|---|---|---|
| 3,408,064 | 10/1968 | Johnson et al. | 271/61 |
| 3,599,972 | 8/1971 | Miciukiewicz | 271/39 |
| 3,919,972 | 11/1975 | Komori et al. | 271/160 X |
| 4,358,102 | 11/1982 | Hoshizaki et al. | 271/164 |
| 4,591,141 | 5/1986 | Wentzel et al. | 271/127 |
| 4,830,353 | 5/1989 | Hendriks et al. | 271/160 X |
| 5,232,215 | 8/1993 | Hashimoto et al. | 271/160 |
| 5,398,108 | 3/1995 | Morinaga et al. | 355/309 |

FOREIGN PATENT DOCUMENTS 47146600 9/1974 Japan .

*Primary Examiner*—Robert Beatty
*Attorney, Agent, or Firm*—Tallam Nguti

[57] ABSTRACT

A high capacity portable sheet cassette tray assembly for supporting and positioning a stack of sheets for feeding reliably, one at a time, in a sheet using machine. The high capacity cassette tray assembly includes a cassette frame for removing and reinstalling into a sheet supply station of the sheet using machine. The cassette frame has a front end over which sheets are fed into the machine, and forward feed corner snubbers that are mounted to the front end of the cassette frame. The high capacity cassette tray assembly also includes a liftable base plate mounted within the cassette frame for supporting a high capacity stack of sheets having a topmost sheet. Further, the high capacity cassette tray includes a constant angle parallelogram lifting assembly that has a rear end connected to the cassette frame, and a front end connected to the liftable base plate for lifting and supporting the base plate and a topmost sheet of a stack of sheets on the base plate. The base plate and a topmost sheet of a stack of sheets, as lifted and supported regardless of a number of sheets in the stack of sheets, have a continuously constant sheet feeding angle relative to a horizontal plane through the forward feed corner snubbers of the cassette frame.

9 Claims, 7 Drawing Sheets

REPRODUCTION MACHINE HAVING A HIGH CAPACITY CASSETTE TRAY ASSEMBLY

BACKGROUND OF THE INVENTION

This invention relates to reproduction machines, in general, and particularly to such a machine having a high capacity cassette tray assembly for effectively and reliably holding and positioning stacks of sheets for feeding within the reproduction machine.

Reproduction machines include but are not limited to electrostatographic process machines. Generally, the process of electrostatographic reproduction machines includes uniformly charging an image frame of a moving photoconductive member, or photoreceptor, to a substantially uniform potential, and imagewise discharging it or imagewise exposing it to light reflected from an original image being reproduced. The result is an electrostatically formed latent image on the image frame of the photoconductive member. For multiple original images, several such frames are similarly imaged. The latent image so formed on each frame is developed by bringing a charged developer material into contact therewith. Two-component and single-component developer materials are commonly used. A typical two-component developer material comprises magnetic carrier particles, also known as "carrier beads," having fusable charged toner particles adhering triboelectrically thereto. A single component developer material typically comprises charged toner particles only.

In either case, the fusable charged toner particles when brought into contact with each latent image, are attracted to such image, thus forming a toner image on the photoconductive member. The toner image is subsequently transferred at a transfer station to an image receiver copy sheet. The copy sheet is then passed through a fuser apparatus where the toner image is heated and permanently fused to the copy sheet forming a hard copy of the original image. The copy sheets typically are held and positioned (for feeding to the transfer station) in a motorized elevator sheet supply assembly within the machine, or in a non-motorized portable or removable spring and pivot cassette tray assembly.

Conventional non-motorized spring loaded and pivoting type cassette trays or tray assemblies are well known. Typically, forward feed corner snubber type cassette trays can effectively hold and position only up to a maximum of 250 sheets per full tray for feeding in image reproduction machines. The following patents disclose examples of such cassette trays.

U.S. Pat. No. 4,591,141 entitled "First Point Sheet Feeder", discloses a sheet feeder that is pivotably mounted so that the paper supply is maintained in contact with a fixed portion feed roller. The sheet feeder's pivot point is selected to provide constant feed pressure to the paper supply regardless of the size of the remaining paper supply.

U.S. Pat. No. 4,358,102 entitled "Copy Paper Feeding Cassette" discloses a cassette that has a cutout or gate centrally defined in each wall of the cassette. The cassette also has a reinforcing plate pivotally mounted at a forward portion of each side wall. Upon mounting in a machine, the reinforcing plates bridge the cutouts or gate and cooperate with machine members to prevent skewed feeding of a topmost sheet.

U.S. Pat. No. 3,599,972 entitled "Paper Tray for Photocopy Machine" discloses a floating feed tray including a pair of feed rollers positioned above the forward end of the tray and mounted on a fixed axis. The rearward end of the tray is biased downwardly to pivot the tray about a pivot point so as to raise the forward end to bring the topmost sheet into feeding engagement with the feed rollers.

JP 47-146600 (Canon KK) Sep. 9, 1974, Utility Model discloses a paper feeding cassette including a sheet separating pivot or snubber that shifts from the paper feeding positions when sheets are being loaded.

U.S. Pat. No. 3,408,064 entitled "Auxiliary Paper Tray for Copying Machine" discloses a paper tray that has lateral and end guides or walls that are fixedly attached to the bottom plate of the tray to accommodate a stack of sheets.

Such non-motorized conventional cassette trays, for example, those that have forward feed corner snubbers cooperating with a feed roller, are very sensitive to a sheet feeding angle of the top of a stack of sheets relative to the feed roller and the corner snubbers. The effectiveness and reliability of sheet feeding from such a cassette tray are also very sensitive to the penetration distances or displacement made by the cooperating feed roller into a stack of sheets during a feed stroke of the feed roller or wheel. Such sensitivities have ordinarily limited the size of any stack of sheets that can be held by such a tray. For example, a stack of standard 20# sheets is ordinarily limited to 250 sheets or less.

There has therefore been a need for a relatively low cost, and reliable feed roller and corner snubber type cassette tray that can hold and position stacks of sheets greater than the ordinarily limited 250 sheet maximum.

SUMMARY OF THE INVENTION

In accordance with the present invention, there is provided a high capacity sheet cassette tray assembly for supporting and positioning a stack of sheets for feeding reliably, one at a time, in a sheet using machine. The high capacity cassette tray assembly includes a cassette frame for removing and reinstalling into a sheet supply station of the sheet using machine. The cassette frame has a front end over which sheets are fed into the machine, and forward feed corner snubbers that are mounted to the front end of the cassette frame. The high capacity cassette tray assembly also includes a liftable base plate mounted within the cassette frame for supporting a high capacity stack of sheets having a topmost sheet. The high capacity tray assembly further includes a constant angle lifting assembly that has a rear end connected to the cassette frame, and a front end that is connected to the liftable base plate for lifting and supporting the base plate and a topmost sheet of a stack of sheets on the base plate. The base plate and a topmost sheet of a stack of sheets, as lifted and supported regardless of a number of sheets in the stack of sheets, have a continuously constant sheet feeding angle relative to a horizontal plane through the forward feed corner snubbers of the cassette frame.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 6:
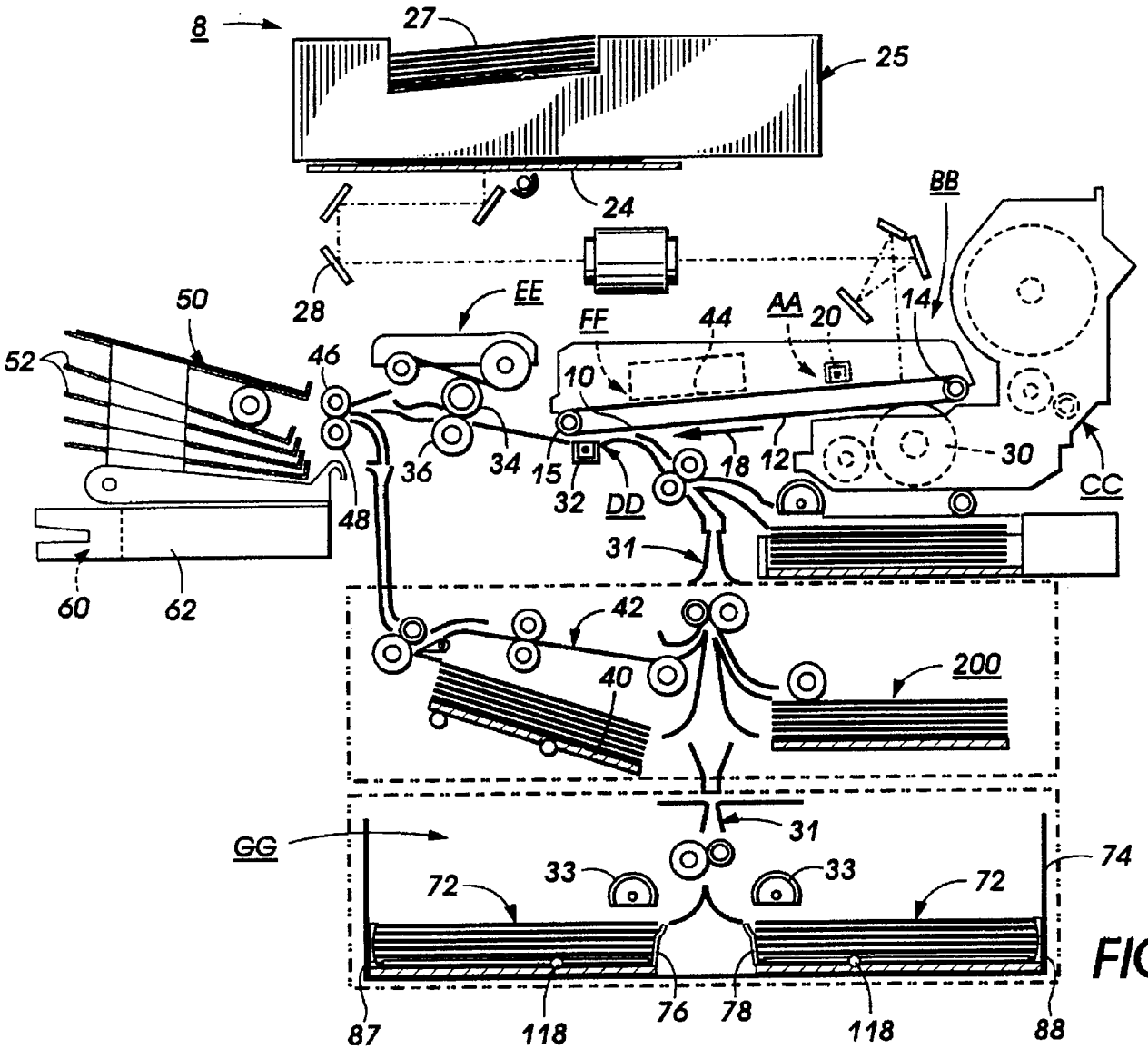
FIG. 6 is a vertical schematic of an exemplary electrostatographic reproduction machine including the high capacity sheet cassette tray assembly in accordance with the present invention.

Referring first to FIG. 6, an exemplary electrostatographic reproduction machine 8 according to the present invention is illustrated As shown, the machine 8 has conventional imaging processing stations associated therewith, including a charging station AA, an imaging/exposing station BB, a development station CC, a transfer station DD, a fusing station EE, and a cleaning station FF. Importantly, the machine 8 includes a sheet supply station shown generally as GG, that includes the non-motorized high capacity cassette tray assembly of the present invention (to be described in detail below). The sheet supply station GG advantageously may also include a conventional snubber type cassette tray assembly shown as 200.

As shown, the machine 8 has a photoconductive belt 10 with a photoconductive layer 12 which is supported by a drive roller 14 and a tension roller 15. The drive roller 14 functions to drive the belt in the direction indicated by arrow 18. The drive roller 14 is itself driven by a motor (not shown) by suitable means, such as a belt drive.

The operation of the machine 8 can be briefly described as follows. Initially, the photoconductive belt 10 is charged at the charging station AA by a corona generating device 20. The charged portion of the belt is then transported by action of the drive roller 14 to the imaging/exposing station BB where a latent image is formed on the belt 10 corresponding to the image on a document positioned on a platen 24 via the light lens imaging system 28 of the imaging/exposing station BB. It will also be understood that the light lens imaging system can easily be changed to an input/output scanning terminal or an output scanning terminal driven by a data input signal to likewise image the belt 10. As is also well known, the document on the platen 24 can be placed there manually, or it can be fed there automatically by an automatic document handler device 25 that includes a multiple document sheet holding tray 27.

The portion of the belt 10 bearing the latent image is then transported to the development station CC where the latent image is developed by electrically charged toner material from a magnetic developer roller 30 of the developer station CC. The developed image on the belt is then transported to the transfer station DD where the toner image is transferred to a copy sheet fed from a sheet cassette tray, for example, from the high capacity sheet cassette tray assembly 70, 72 of the present invention (to be described in detail below). As shown, the sheets are fed, for example, by a copy sheet handling system 31 that each include a feed roller 33.

At the transfer station DD, a corona generating device 32 is provided for charging the copy sheet so as to attract the charged toner image from the photoconductive belt 10 to the copy sheet. The copy sheet with the transferred image thereon is then directed to the fuser station EE. The fuser apparatus at station EE includes a heated fuser roll 34 and backup pressure roll 36. The heated fuser roll 34 and pressure roll 36 rotatably cooperate to fuse and fix the toner image onto the copy sheet. The copy sheet then, as is well known, may be selectively transported to the finishing area, or to a duplex tray 40 along a selectable duplex path 42 for duplexing.

The portion of the belt 10 from which the developed image was transferred is then advanced to the cleaning station FF where residual toner and charge on the belt are removed by a cleaning device such as a blade 44, and a discharge lamp (not shown) in order to prepare the portion for a subsequent imaging cycle.

When not doing duplex imaging, or at the end of such duplex imaging, the copy sheets upon finally leaving the fusing rolls 34, 36, are passed to finishing area input rolls 46 and 48. From the input rolls 46, 48, the copy sheets are fed, for example, individually to an output tray (not shown) or to a bin sorter apparatus 50 where the sheets can be arranged in a collated unstapled set within the tray or within each bin 52 of the bin sorter apparatus. The bin sorter apparatus 50 can comprise any number of bins 52, which as are well known, can be designed to nest, as well as to indexably cycle past a fixed loading point for sheets. A machine user making such set of copy sheets on the reproduction machine 8 can thus manually remove each such set at a time, and insert a corner or edge of the set into a convenience stapler assembly 60 that is built into a portion 62 of the frame of the machine 8.

Figure 5A:
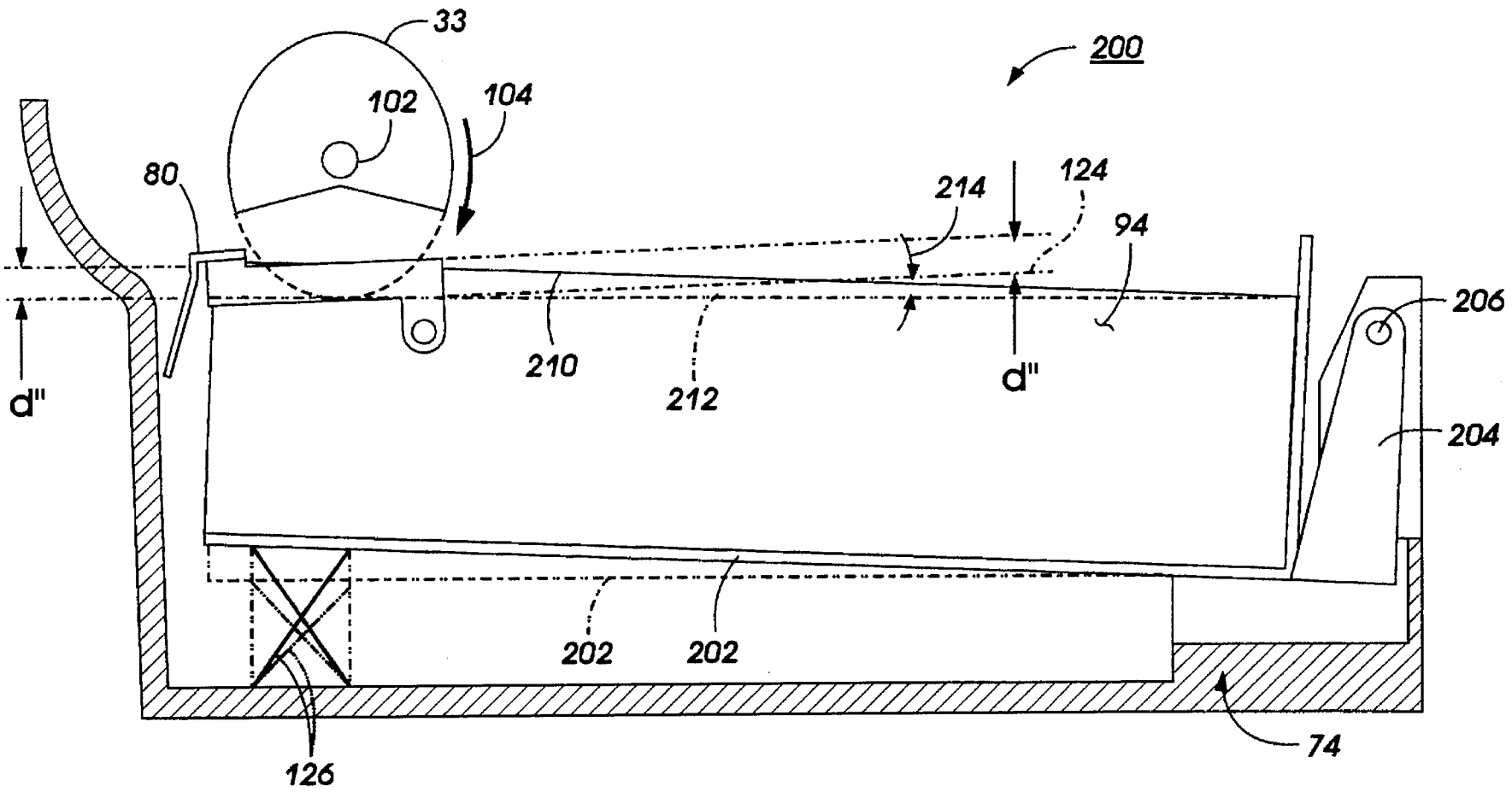
FIG. 5A PRIOR ART
FIG. 5A is a schematic side view of a conventional snubber type cassette tray assembly in a full position, ready to feed.
Figure 5B:
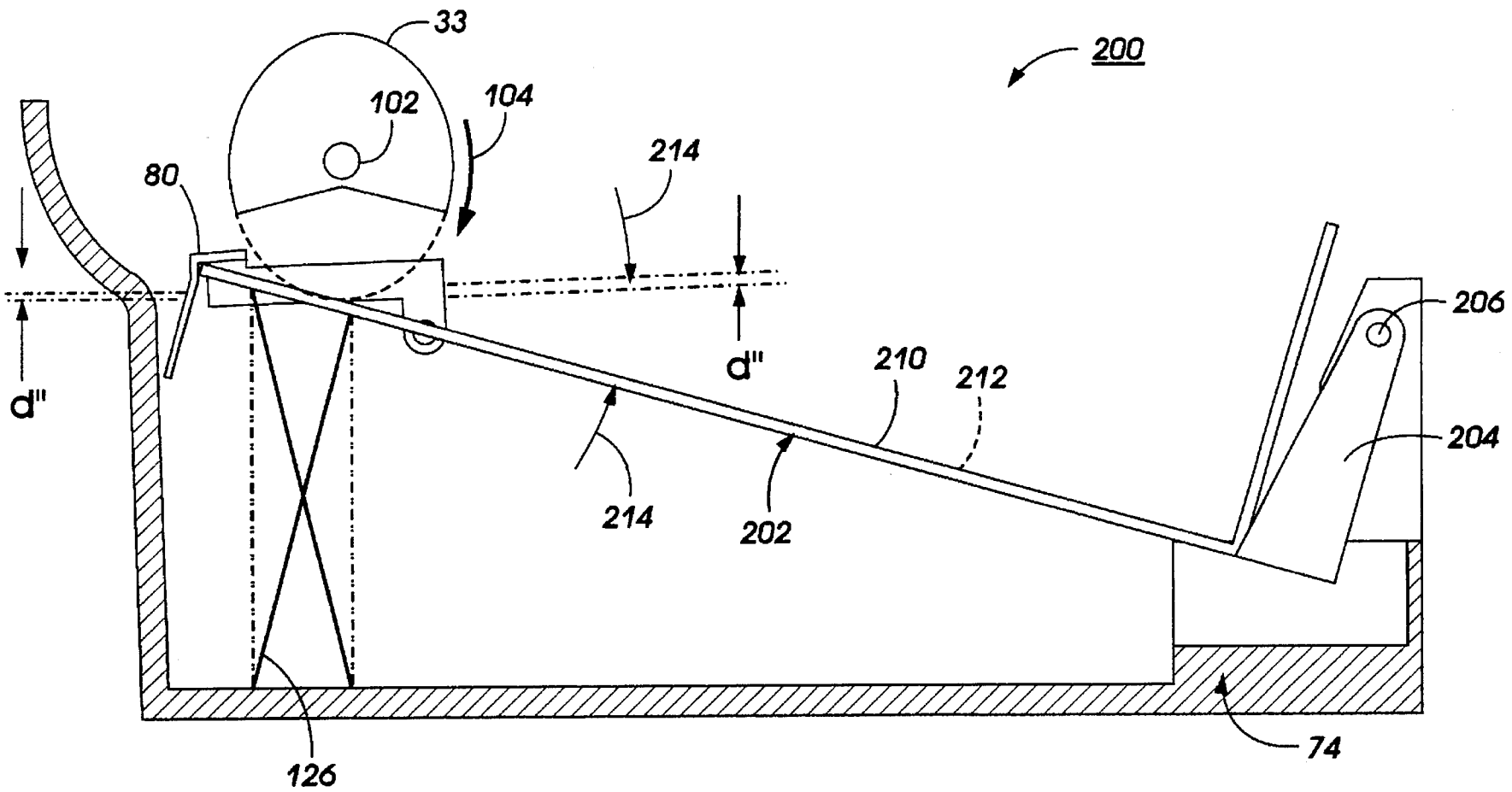
FIG. 5B PRIOR ART
FIG. 5B is a schematic side view of the cassette tray assembly of FIG. 5A in a near empty position, ready to feed.

Referring first to FIGS. 5A and 5B, a conventional cassette tray assembly 200 is illustrated, for example. In FIG. 5A, the conventional cassette tray assembly is shown filled with a stack of sheets. It has a single piece base plate 202 that is mounted pivotably by a bracket 204 at 206 to a cassette frame 74. The base plate 202 is supported by a compression spring 126 towards its front end, below a feed wheel or roller 33. As shown, the topmost sheet in the stack has a plane 210 in a home or non-feeding position, and a plane 212 when the springs 126 are compressed by the feed wheel 33 during a feeding stroke.

When a conventional cassette tray is filled with a stack of sheets as such, the penetration d" that the feed wheel achieves in moving the plane of the front section of the topmost sheet from the home to the feed position 210 to 212, respectively, has been found to be about 6.2 mm. A sheet feeding angle 214 measured relative to a horizontal plane at the point of sheet contact is approximately 2°. Full conventional cassette trays therefore work more reliably and effectively than partially full to near-empty ones.

Unfortunately, however, as shown in prior art FIG. 5B, when the conventional cassette tray 200 is near empty, for example with only about 5 sheets in it, the home position 210 and feed position 212 of the plane of the topmost sheet at the point of contact with the feed wheel 33, are nearly identical. Consequently, feed wheel penetration d" here has been found to be only about 0.4 mm. Note, however, that the sheet feeding angle 214 undesirably has increased substantially from that of 2° of a full conventional tray (FIG. 5A). Such an increase has been found to be more than 9°, making the angle 214 approximately 11.3° at the near empty state of the conventional tray. Such variability in both the sheet feeding angle 214, and the feed wheel penetration d" are what undesirably limit sheet holding capacity and sheet feeding reliability in conventional, non-motorized snubber type cassette trays.

Figure 1:
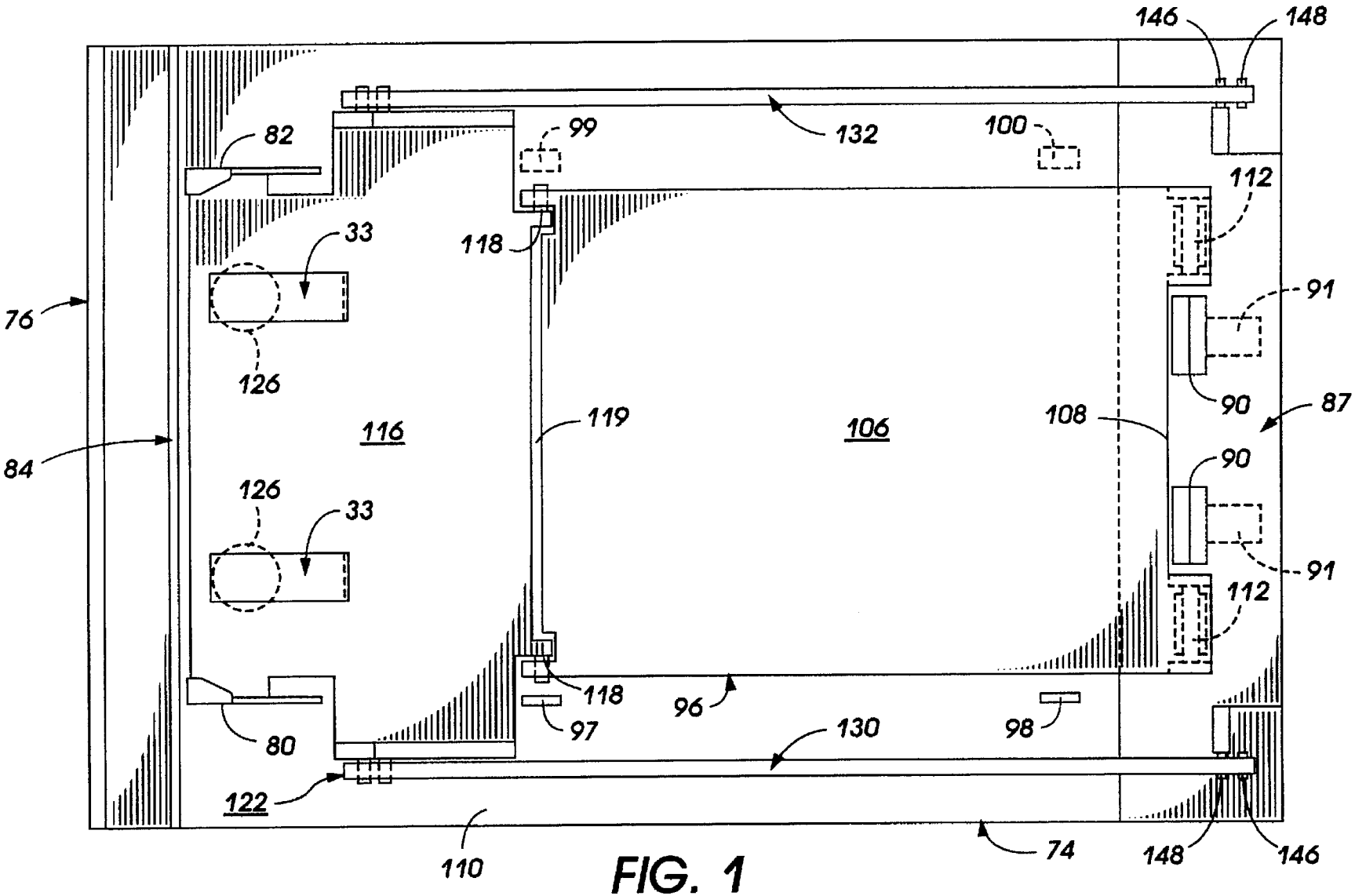
FIG. 1 is a schematic plan view of the high capacity sheet cassette tray assembly of the present invention.

Referring now to FIGS. 1–4, the high capacity sheet cassette tray assembly 70, 72 of the present invention is illustrated in detail. Cassette tray assemblies 70 and 72 are generally identical in design and operation except that tray 70 is adapted to feed sheets short edge first, and tray 72 long edge first. Therefore, a detail description of one will suffice for the other. As shown in FIG. 1, the sheet cassette tray assembly 70, 72 of the present invention includes a cassette frame 74 that can be removed and reinstalled into the sheet supply station GG of the machine 8. The cassette frame 74 as is well known can be a portable frame member that contains a single cassette tray and that can be completely removed from the sheet supply station, placed on a platform to be reloaded with sheets, and then reinstalled into the supply station. Alternatively, as illustrated (FIG. 6) the cassette frame 74 can be part of a multiple tray drawer frame usually holding more than one non-motorized cassette tray. The drawer frame is retractable from the sheet supply station for sheet reloading, and is reinstallable into a sheet feeding position within the sheet supply station of the machine.

The cassette frame 74 in either case has a front, or feeding end 76 (for short edge fed sheets) or 78 for long edge fed sheets (FIG. 6) over which sheets are fed one at a time to the image transfer station DD of the machine 8. The front end 76, 78 has a pair of forward feed corner snubbers 80, 82, mounted one to each corner of such front end 76, 78. The front end 76, 78 also includes a first sheet guiding wall 84 for supporting the lead edges of a stack of sheets advantageously relative to the corner snubbers 80, 82.

The cassette frame 74 also includes a rear end 87, 88 that has a second sheet guiding wall 90. The second sheet guiding wall 90 has a surface 92 that includes a concave curvature for aligns the rear edge of a stack 94 of sheets within the cassette tray assembly 70, 72, such that the sheets fit precisely within the tray and without buckling. In the short edge first feeding tray 70, the rear wall 90 is adjustable backwards and forwards via a device 91 so as to enable handling of sheets of various lengths, such as letter size and legal size length sheets. Importantly however, the first and second walls 84, 90 thus cooperate in each tray assembly 70, 72 to place the leading edge of each topmost sheet of the stack 94 of sheets at a constant position relative to the forward feed corner snubbers 80, 82.

Still referring to FIGS. 1–4, the cassette tray assembly 70, 72 of the present invention includes a movable (liftable and lowerable) sheet support base plate, shown generally as 96. The base plate 96 is mounted within the cassette frame 74 so that it extends from the rear wall 90 to the front wall 84 for supporting a high capacity stack 94 of sheets. As illustrated, the base plate 96 is mounted within the cassette frame 74 so that it is centered between two pairs of sheet registration guide members 97, 98, and 99, 100 for registering sheets between the outboard and inboard sides of the tray 70, 72 as shown in FIG. 1. A pair of selectively driven half-moon feed wheels or rollers 33 ( also see FIG. 6) are mounted over each tray within the machine 8 at the sheet supply station GG. The feed rollers 33 are mounted as such in an aligned position over a front portion of the base plate 96 when the cassette tray assembly 70, 72 is installed within the machine in a sheet feeding position. The feed wheels or rollers 33 are mounted so as to have a fixed position axis 102, and hence a fixed path 104 relative to the cassette frame 74 in the installed, sheet feeding position within the machine.

More importantly, in accordance with the present invention, the base plate 96 is divided into two rear-to-front sections that include a rear plate section 106 for supporting the rear or back portion of a stack 94 of sheets. A rear edge 108 of the rear plate section 106 is supported on a raised portion 109 of a base 110 of the cassette frame 74. As also shown, the rear edge 108 is supported there pivotably and, in part, rotatably on a pair of support rollers 112 for transmitting part of the weight of the stack 94 of sheets through the support roller 112 to the cassette frame 74. As shown, the two rear-to-front sections also include a front plate section 116 that is connected pivotably by a pivot assembly 118 to the rear plate section 106 so as to enable the front plate section 116 to be liftable at a continuously constant sheet feeding angle shown as 120 (FIGS. 2–4) relative to the forward feed corner snubbers 80, 82, or more specifically to a horizontal plane 124 or horizontal tangent 124 to the circular path 104 of the feed wheel 33.

Figure 2:
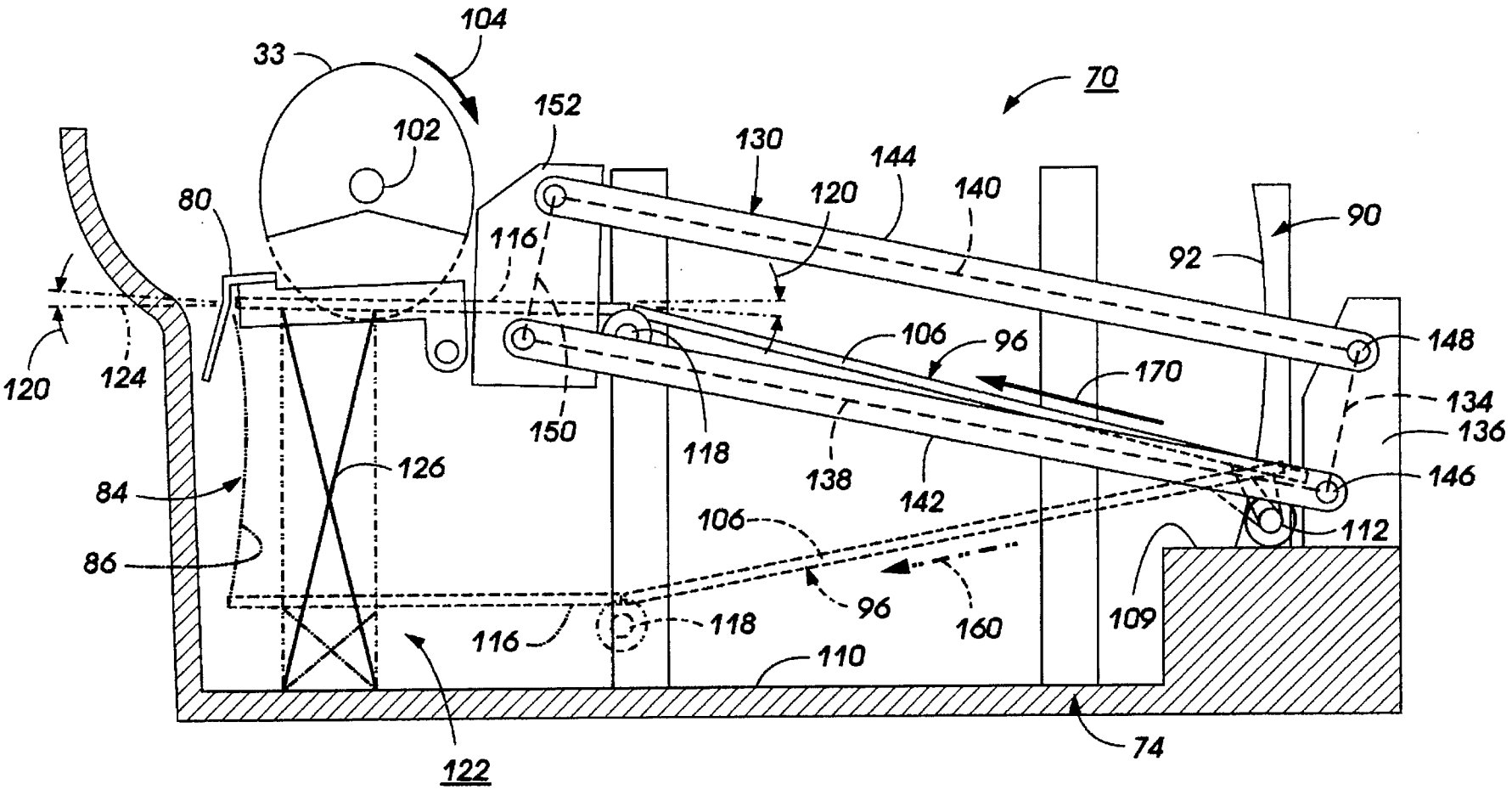
FIG. 2 is a schematic side view of the cassette tray assembly of FIG. 1 in an empty home position.

Referring still to FIGS. 1–4, the cassette tray assembly 70, 72, importantly and advantageously includes a constant angle lifting assembly shown generally as 122 for lifting and supporting the base plate 96 and a topmost sheet of a stack 94 of any number of sheets (including a maximum of about 500 sheets), at the continuously constant sheet feeding angle 120 (of about 2°). The sheet feeding angle 120 is formed by a front section of the plane of the topmost sheet in a stack on the front plate section 116 relative to the horizontal plane or tangent 124 to the circular path 104 of the feed wheel 33. As shown, the constant angle lifting assembly 122 includes a pair of compressible springs 126 (FIG. 1) that are mounted to the base 110 of the cassette frame 74 for supporting and lifting the front plate section 116 from a full tray position (FIG. 3) to an empty tray position (FIG. 2). The design and operation of the lifting assembly 122 is such that it can raise or lift the base plate sections 106, 116 (rear and front, respectively) and any number of sheets in a stack 94 thereon, in such a manner that a topmost plane 128 of the front portion of the topmost sheet, forms the constant sheet feeding angle 120 (of about 2°) with the horizontal plane or tangent 124 to the circular path 104 of the feed wheel 33. Additionally, the lifting assembly 122 is designed to raise such a stack so that each of the feed wheels or rollers 33 achieves a constant penetration shown as d' beneath the home position of the plane 128 of the topmost sheet, during a feed stroke. A feed stroke is achieved when the uncut circumferential portion of the half-moon feed wheels 33 rotate into displacement contact with the front portion of a topmost sheet, thus compressing the lifting springs 126 and displacing the plane 128 downwardly (see FIG. 3 dashed-line positions) by the penetration distance d'.

Figure 3:
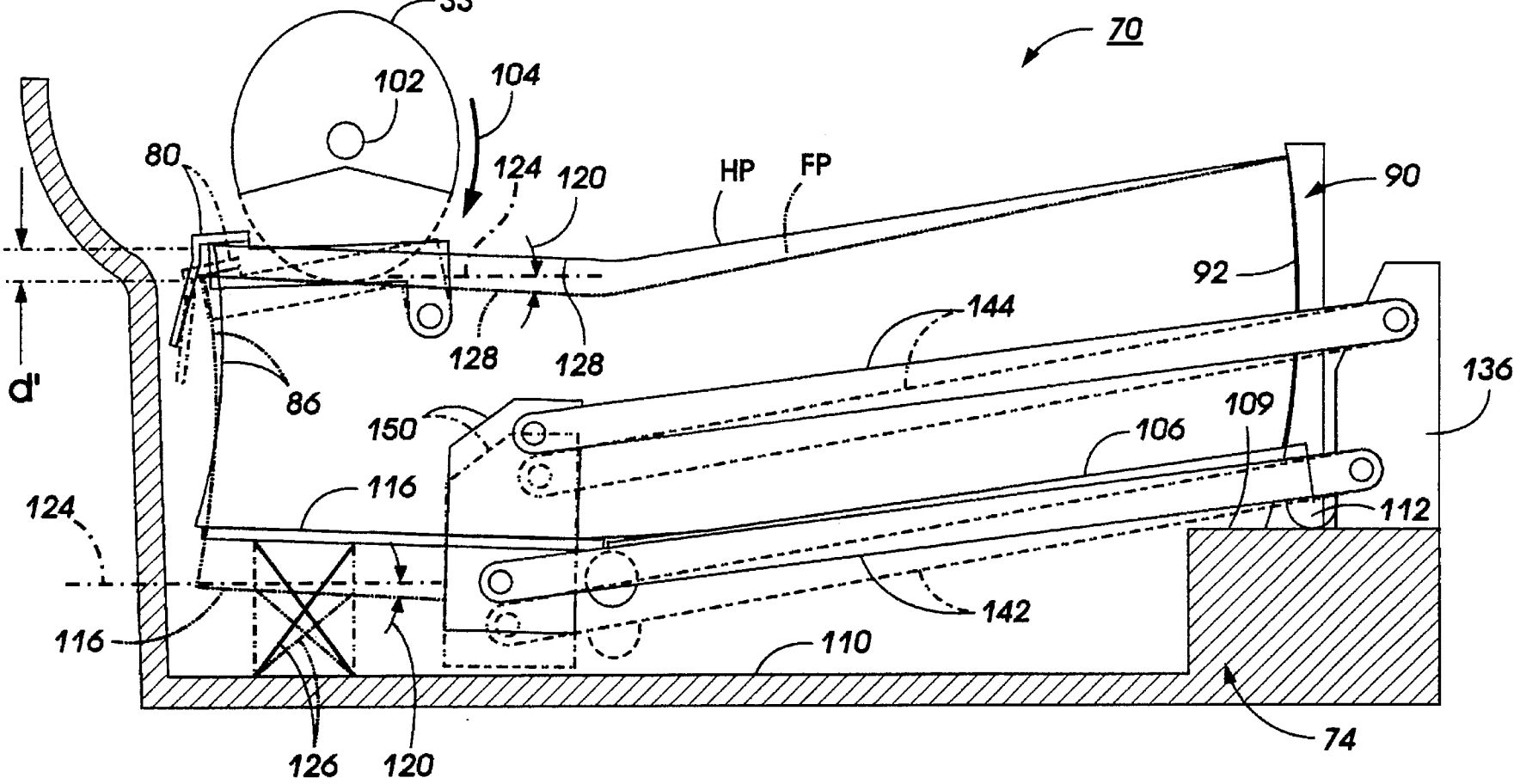
FIG. 3 is a schematic side view of the cassette tray assembly of FIG. 1 holding a high capacity stack of sheets in a full position, ready to feed.
Figure 4:
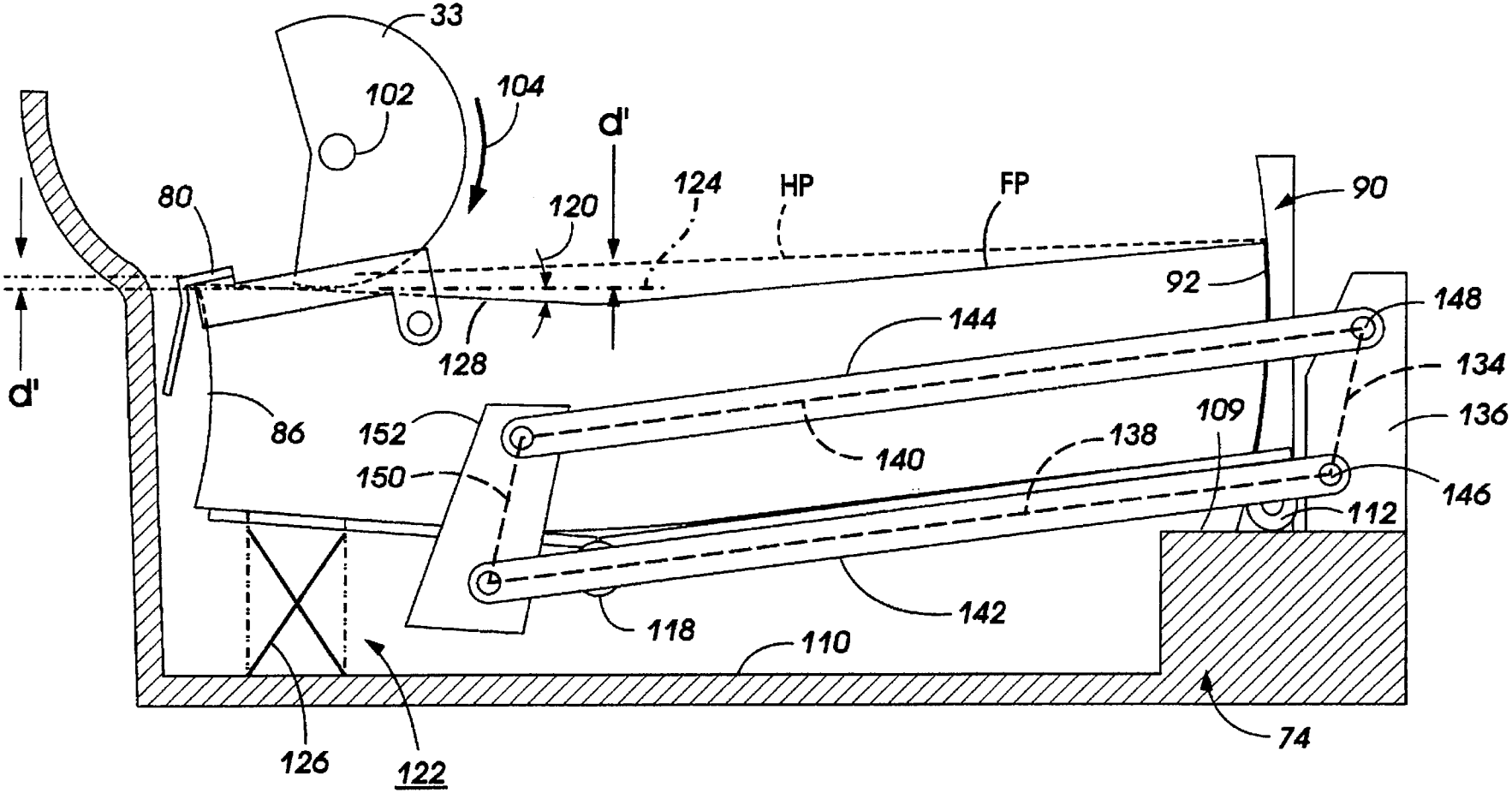
FIG. 4 is a schematic side view of the cassette tray assembly of FIG. 3 in a less than full position, ready to feed.

In FIGS. 3–4 particularly FIG. 3, the planes of sheets in their home positions are shown as HP, and the same planes are shown as FP when displaced by the feed wheels 33 by depressing the springs 126 in order to place the topmost sheet in a feeding position. The cooperating curvature of the rear wall 90 acts to prevent drag forces on the ends of a stack of sheets being lifted from a full position to an empty position of the tray 70, 72.

More importantly, the constant angle lifting assembly 122 further includes a pair of four-bar/four-link linkage mechanisms 130, 132, each including a rear end that is mounted to the cassette frame 74. The mechanisms 130, 132 are mounted as such so that one is to each side of the stack supposing base plate 96. As illustrated, particularly in FIGS. 2–4, each four-bar/four-link linkage mechanism 130, 132 includes a fixed position first link 134 that is formed by pivot points in a first bar 136 which is mounted fixedly to the raised portion 109 of the base 110 (of the cassette frame 74). Each linkage mechanism 130, 132 also includes a second link 138, and a third link 140 that are formed by pivot points in a second bar 142 and in a third bar 144, respectively. The second and third bars 142, 144 are each connected at one end thereof, and pivotably by cylindrical pins 146, 148, respectively, to the first bar 136, as shown. The second and third links 138, 140, respectively, are importantly made equal in length, and are mounted, spaced from each other by the first link 134, at the first bar 136.

As illustrated, each linkage mechanism 130, 132 further includes a fourth and final link 150 that is formed by pivot points in a fourth bar 152 that is connected to the second and third bars 142, 144, as well as advantageously to the front plate section 116 of base plate 96. The second and third bars 142, 144 are connected pivotably to the fourth bar 152 so that the fourth link 150 is equal in length, and is parallel to, the first link 134. As such, the second and third links 138, 140 which are also equal in length, will also be parallel to each other. The result as clearly illustrated is a four-bar drag-link type parallelogram mechanism in which the first link 134 is fixed at an angle that positions the plane of the front plane section 116 (FIG. 2) at an advantageous and desired sheet feeding angle 120. The advantage of this type of mechanism is that the link (link 150) opposite to the fixed link (link 134) will also be held at that same angle as the fixed link, even when the second and third links 138, 140 rotate about the cylindrical pins 146, 148 from a full to an empty position of the tray 70, 72. As a result, the angle 120 of the plane of the front plate section will also remain constant even when the second and third links 138, 140 rotate as such.

Another primary objective of the present invention in using the parallelogram plate lifting mechanisms 130, 132 is to keep the penetration d' of the feed rolls 33 constant no matter the height of the stack, and no matter the number of sheets in the stack. This is accomplished by keeping the angle of the front plate section 116 of the base plate 96, as well as that of the front portion of the plane of the topmost sheet of a stack under the feed rolls 33 constant and equal to the sheet feeding angle shown as 120.

To reiterate, the opposite links of the parallelogram mechanisms 130, 132 are equal and parallel. This results in a mechanism in which when one link is held at a fixed angle, the opposite link is held at that same fixed angle, no matter the rotation of the connecting links. Any parts, such as the front plate section 116, that is attached to the moving link which is opposite the fixed link, will also move at a constant angle.

Importantly, in accordance with the present invent on, the front plate section 116 of the base plate is attached to the moving link, that is, to the fourth link 150. Since this link 150 is opposite to the fixed first link 134, it will therefore stay at a constant angle as the four-bar linkages 130, 132 move or rotate up and down. The front plate section 116 under the feed rolls 33, will therefore also stay at a constant angle throughout such movement.

The penetration d' of the feed rolls 33 is, in part, controlled by the location of the axis 102 and path of rotation 104 of the feed rolls given the position of the cassette frame. The penetration d' is also importantly controlled in part by the sheet feeding angle 120. In each of the FIGS. 2–4, the home position of the the plane of the topmost sheet on a stack is defined by the topmost sheet contacting and stopping against the corner snubbers 80, 82. Since the location of the feed roll (that is, the axis 102, and the path 104) relative to the snubbers 80, 82 is fixed, the amount of feed roll penetration d' will be controlled more importantly therefore by the sheet feeding angle 120. Since the sheet feeding angle 120 is constant owing to use of the parallelogram four bar plate lifting mechanisms 130, 132, the amount of penetration d' will therefore also be constant.

The back plate section 106 of the base plate 96 is made to pivot at the pivot assemblies 118 and 112 so as to reduce the amount of weight of a stack of sheets that is being supported by the normal force of the springs 126. For example, the front plate section 116 is made only long enough to effectively support 80 mm of the length of a sheet. This length of the front section 116 was selected as a balance between a desire to support enough of the sheet so as to ensure its flatness beneath the feed rolls 33, and a desire to minimize the amount of weight of the sheet to be supported by the springs 126. On the other hand, the length of the rear plate section 106 is a bit longer, preferably at about 120 mm long so as to be sufficient to support a good part of the rest of the total length of the sheet. In the case of long edge fed first sheets (tray 72), the overall in-track dimension of the sheet is less, hence the remaining or rear portion of the sheet length is shorter, and thus tends to stay straight or flat even while unsupported. In the case of short edge fed first sheets (tray 70), the remaining sheet length which is longer, can be supported by the cassette frame drawer 74.

Referring in particular to FIG. 2, the pivot assembly 118 includes the gap 119, and the edges of the front plate section 116 and rear plate section 106 at the pivot 118 are additionally chamfered. This allows the base plate sections 116, 106 to be able to assume a belly-down position 160 when fully down. Compare this to a fully-or near-empty belly-up position 170 of the sections. The fully compressed height of the springs 126, and the operation of the parallelogram mechanisms 130, 132 insure that the front plate section 116 as equally as the plane 128 of the front portion of the topmost sheet, are constantly held at the constant sheet feeding angle 120. The rear plate section 106, however, is adapted to support the rear section of a stack of sheets such that the rear portion of the plane of the topmost sheet in the stack will have a larger, and varying angle relative to a horizontal plane that is drawn through the support rollers 112, for example, depending on the number of sheets in the stack.

It is, therefore, apparent that there has been provided in accordance with the present invention, a high capacity sheet cassette tray assembly that fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. A high capacity non-motorized sheet cassette tray assembly for supporting and positioning a stack of sheets for feeding reliably one at a time in a sheet using machine, the high capacity cassette tray assembly comprising:

(a) a cassette frame for removing and reinstalling into a sheet supply station of the sheet using machine, said cassette frame having a front end over which sheets are fed into the machine, and forward feed corner snubbers mounted to said front end;

(b) a liftable base plate mounted within said cassette frame for supporting a high capacity stack of sheets having a topmost sheet; and (c) a constant angle lifting assembly having a rear end connected to said cassette frame, and a front end connected to said liftable base plate for lifting and supporting said base plate and a topmost sheet of a stack of sheets on said base plate, said constant angle lifting assembly including a pair of four-link parallelogram linkage mechanisms, each said linkage mechanism including a fixed position first link mounted to a rear end of said cassette frame, and a set of movable second, third and fourth links connected therefrom for movement relative to said first link, so that said base plate and a topmost sheet as lifted and supported, regardless of a number of sheets in the stack, have a continuously constant sheet feeding angle relative to a horizontal plane through said forward feed corner snubbers of said cassette frame.

2. The high capacity cassette tray assembly of claim 1, wherein said constant angle lifting assembly includes a spring assembly and a pivoting assembly for lifting and supporting any number of sheets in a stack of sheets having a topmost plane on said base plate, such that said topmost plane of the stack is displaceable a constant distance by a sheet feeding roller from a home position into a sheet feeding position regardless of the number of sheets in the stack.

3. The high capacity cassette tray assembly of claim 1, wherein said cassette frame includes a rear end having a sheet edge supporting wall having a concave surface for supporting a rear edge and effectively positioning a leading edge, of each topmost sheet of a stack relative to said forward feed corner snubbers.

4. The high capacity cassette tray assembly of claim 1, wherein said liftable base plate comprises a pair of rear-to-front plate sections including a rear plate section supported pivotably to a rear end of said cassette frame, and a front plate section pivotably connected to said rear plate section so as to be liftable at said continuously constant sheet feeding angle.

5. The high capacity cassette tray assembly of claim 1, wherein said continuously constant sheet feeding angle is approximately two degrees, regardless of a number of sheets in the stack of sheets.

6. The high capacity cassette tray assembly of claim 2, wherein the constant displacement distance of a front portion of the topmost plane of any stack of sheets on said base plate comprises a compression of about 6.2 mm of the spring assembly by the sheet feeding roller to move the topmost plane from a home position to a sheet feeding position.

7. A reproduction machine comprising:

(a) a frame;

(b) means, including a movable image bearing member mounted to said frame, for forming a toner image on said image bearing member;

(c) an image transfer station for transferring the toner image onto a copy sheet; and (d) a sheet supply station for holding and feeding copy sheets one at a time to said image transfer station, said sheet supply station, including:

(i) a sheet feeding position;

(ii) a pair of half-moon, rotatable feed rollers mounted over said sheet feeding position, said feed rollers having a fixed axis and a fixed path of rotation; and (iii) a non-motorized high capacity sheet cassette tray assembly for holding and reliably positioning a stack of sheets for feeding by said feed rollers, said cassette tray assembly including a base plate and a pair of constant angle parallelogram lifting mechanisms connected to a cassette frame and to said base plate for lifting said base plate and a stack of any number sheets on said base plate at a constant sheet feeding angle relative to a horizontal tangent to said path of rotation of said feed rollers.

8. The reproduction machine of claim 7, wherein said non-motorized high capacity sheet cassette tray assembly includes a cassette frame and a pair of compressible springs mounted to said cassette frame for lifting said base plate relative to said cassette frame.

9. The reproduction machine of claim 8, wherein said base plate comprises a separate front plate section supported on said pair of springs, and a separate rear plate section mounted pivotably to said separate front plate section and to said cassette frame for allowing said separate front plate section to be lifted at said constant sheet feeding angle.

* * * * *